US010252847B2

(12) United States Patent
Bugenske et al.

(10) Patent No.: US 10,252,847 B2
(45) Date of Patent: Apr. 9, 2019

(54) PACKAGING CLOSURE ADAPTER

(71) Applicant: Specialty Lubricants Corp., Macedonia, OH (US)

(72) Inventors: Steven James Bugenske, Macedonia, OH (US); Mark J. Egle, Munroe Falls, OH (US); John Sinchok, Hudson, OH (US)

(73) Assignee: Specialty Lubricants Corp., Macedonia, OH (US)

( * ) Notice: Subject to any disclaimer, the term of this patent is extended or adjusted under 35 U.S.C. 154(b) by 0 days.

(21) Appl. No.: 16/142,372

(22) Filed: Sep. 26, 2018

(65) Prior Publication Data

US 2019/0023469 A1 Jan. 24, 2019

Related U.S. Application Data

(63) Continuation of application No. 15/061,513, filed on Mar. 4, 2016.

(Continued)

(51) Int. Cl.

| | |
|---|---|
| ***B65D 41/04*** | (2006.01) |
| ***B65D 75/58*** | (2006.01) |
| ***B65D 47/12*** | (2006.01) |

(52) U.S. Cl.

CPC ..... *B65D 75/5877* (2013.01); *B65D 41/04* (2013.01); *B65D 41/0414* (2013.01);

(Continued)

(58) Field of Classification Search

CPC ..... B65D 75/5877; B65D 41/04

(Continued)

(56) References Cited

U.S. PATENT DOCUMENTS 560,719 A * 5/1896 Hueg ..... B29C 47/20 425/191
652,793 A * 7/1900 Low ..... B65D 47/122 222/562

(Continued)

FOREIGN PATENT DOCUMENTS

EP 1 623 932 A1 2/2006
EP 2 674 371 A1 12/2013

(Continued)

OTHER PUBLICATIONS

Amsoil Synthetic, Marine Gear Lube, prior to Mar. 4, 2015.

(Continued)

*Primary Examiner* — Patrick M. Buechner
*Assistant Examiner* — Michael J. Melaragno
(74) *Attorney, Agent, or Firm* — Tucker Ellis LLP; Heather M. Barnes; Michael G. Craig

(57) ABSTRACT

One or more techniques and/or systems are disclosed for a device that can be used to seal an opening of a package to mitigate loss of package contents, and to effectively transfer contents of the package to a target device or system. The device can comprise a base cap that engages with a package opening, such as a fitment, and a nozzle portion. Alternately, the fitment may comprise a fixedly engaged base. The nozzle portion can comprise a portion that selectably engages with two or more target systems, such as through a filling port, and may also selectably engage with a closing cap that can be used to close the opening, by sealing a spout portion of the nozzle.

20 Claims, 16 Drawing Sheets

Related U.S. Application Data

(60) Provisional application No. 62/128,124, filed on Mar. 4, 2015, provisional application No. 62/169,867, filed on Jun. 2, 2015.

(52) U.S. Cl.
CPC ..... *B65D 41/0471* (2013.01); *B65D 47/123* (2013.01); *B65D 75/5883* (2013.01)

(58) Field of Classification Search
USPC ..... 222/562
See application file for complete search history.

(56) References Cited

U.S. PATENT DOCUMENTS 1,407,997 A * 2/1922 Gregory ..... F16N 3/06 222/99
1,538,094 A * 5/1925 Davis ..... B65D 41/04 222/546
1,702,182 A * 2/1929 Vlijmen ..... B65D 47/123 215/307
2,249,832 A * 7/1941 Hubschman ..... B65D 47/18 222/420
2,342,932 A * 2/1944 Fram ..... A47G 19/24 222/542
2,789,717 A * 4/1957 Demke ..... B65D 55/16 215/235
2,861,718 A * 11/1958 Winzen ..... B65D 75/5816 222/105
3,151,777 A * 10/1964 Rooney ..... B65D 47/263 215/253
3,214,881 A * 11/1965 Hayes ..... B65B 7/2842 220/834
3,235,117 A * 2/1966 Mason, Jr. ..... B65D 41/485 215/256
3,265,233 A * 8/1966 Tuuri ..... B65D 50/067 215/213
3,339,773 A * 9/1967 Stull ..... B65D 41/0428 215/329
3,448,896 A * 6/1969 Sakuta ..... B65D 35/12 222/568
3,986,626 A * 10/1976 Montgomery ..... B65D 41/0471 215/216
4,678,098 A * 7/1987 Oka ..... B65D 41/0471 220/289
4,997,107 A * 3/1991 Snyder ..... B65D 35/02 222/107
5,104,013 A * 4/1992 Hawley ..... B65D 35/38 222/566
5,248,071 A * 9/1993 Ray ..... B65D 47/122 222/566
5,441,180 A * 8/1995 Woodruff ..... B05B 11/007 222/327
5,673,808 A * 10/1997 Valyi ..... B65D 41/0414 215/252
6,035,969 A * 3/2000 Pyle ..... F16N 21/04 184/105.2
6,098,845 A * 8/2000 Stern ..... B65D 75/5877 222/83
6,805,261 B1 * 10/2004 Laudenberg ..... B65B 9/087 222/107
7,178,703 B2 * 2/2007 Spada ..... A61F 9/0008 222/209
7,677,422 B2 * 3/2010 Lee ..... B65D 41/0421 222/542
8,434,651 B2 * 5/2013 Miyazaki ..... B65D 41/0471 215/216
D743,255 S * 11/2015 Niggemyer ..... D9/435
9,617,054 B2 * 4/2017 Niggemyer ..... B65D 75/5883
2003/0205584 A1 * 11/2003 Niggemyer ..... B65D 75/5883 222/107
2005/0161348 A1 * 7/2005 Morini ..... B65D 41/3438 206/219
2006/0006194 A1 * 1/2006 Niggemyer ..... B65D 1/0246 222/107
2006/0011668 A1 * 1/2006 Massey ..... B67D 3/04 222/562
2008/0089967 A1 * 4/2008 Bourque ..... A23G 3/0021 425/183
2010/0211040 A1 * 8/2010 Wachman ..... A61J 1/2096 604/403
2010/0213213 A1 * 8/2010 Albers ..... B65D 41/3409 222/153.05
2011/0108572 A1 * 5/2011 Murray ..... B65D 75/5877 222/83
2013/0270293 A1 * 10/2013 Dresser ..... B65D 5/748 222/83
2013/0299445 A1 * 11/2013 Cerracchio ..... B65D 1/0246 215/44
2014/0048557 A1 * 2/2014 Barron ..... B65D 5/748 222/81
2015/0158621 A1 * 6/2015 Lee ..... B65D 45/325 215/44
2015/0203257 A1 * 7/2015 Canegallo ..... B65D 51/226 222/562
2015/0225134 A1 * 8/2015 Kato ..... B65D 41/0471 220/214
2015/0360830 A1 * 12/2015 Niggemyer ..... B65D 75/5883 222/105
2016/0257082 A1 * 9/2016 Ragan ..... B65D 75/008
2017/0121084 A1 * 5/2017 Moorehouse ..... B65D 75/5883

FOREIGN PATENT DOCUMENTS

KR 2003-0069588 A 8/2003
WO 2009/031864 A2 3/2009

OTHER PUBLICATIONS

LubriMatic, High Viscosity Lower Unit Gear Lube, prior to Mar. 4, 2015.
Menshen, Product Catalog, pp. 46-64, 2014.
PCT International Preliminary Report on Patentability from the PCT International Application No. PCT/US2016/020941, dated Sep. 5, 2017, 11 pages.
PCT International Search Report and Written Opinion from International Application No. PCT/US2016/020941, dated Jun. 10, 2016, 14 pages.

* cited by examiner

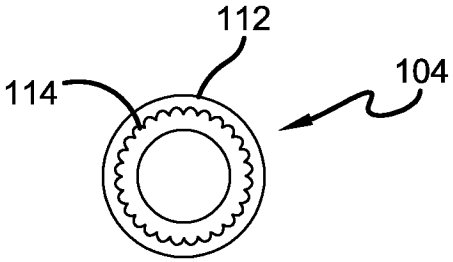
FIGURE 3A
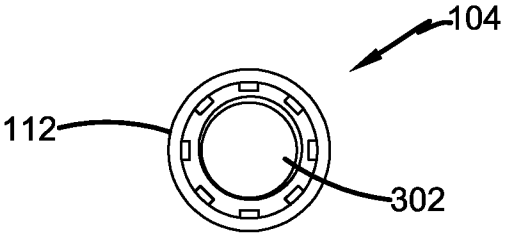
FIGURE 3B
FIGURE 3C
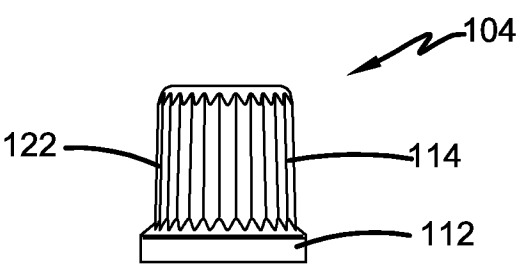
FIGURE 3D
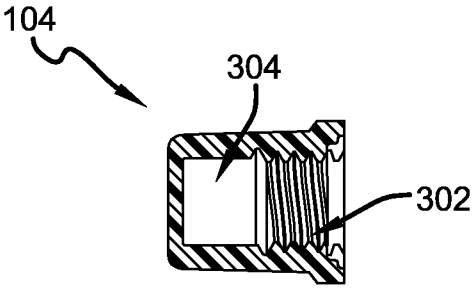
FIGURE 3E

PACKAGING CLOSURE ADAPTER

CROSS-REFERENCE TO RELATED APPLICATIONS

This application is a continuation of patent application U.S. Ser. No. 15/061,513, entitled PACKAGING CLOSURE ADAPTER, filed Mar. 4, 2016, which claims priority to provisional patent application U.S. Ser. No. 62/128,124, entitled PACKAGING CLOSURE ADAPTER, filed Mar. 4, 2015; and claims priority to provisional patent application U.S. Ser. No. 62/169,867, entitled PACKAGING CLOSURE ADAPTER, filed Jun. 2, 2015; all of which are incorporated herein by reference.

BACKGROUND

Packaging can comprise a variety of materials, shapes and sizes. Some packaging is configured to hold fluids and fluid-like materials, and may come in rigid or flexible packaging. Often, packaging for fluids comprises an opening that is configured to transfer the fluid out of the packaging in a desired manner, such as by pouring or pumping. Some flexible packaging may comprise polymer or polymer/plastic materials, into which, spouts or fitments may be welded or otherwise engaged to provide a type of seal around the opening. A variety of materials may be stored in such packaging, such as lubricants and additives, automotive chemicals, household and consumer cleaning products, industrial cleaners and chemicals, personal care products, pet and veterinary products, paints and coatings, and much more.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

As provided herein, a device that can be used to seal an opening of a package, to mitigate loss of package contents, which may also be used to effectively transfer contents of the package to a target system. The device may comprise a type of cap system that can selectably engage with a fitment or be integrated with the fitment, for example, of a flexible package. Further, the cap system may comprise a component that can selectably engage with the target system, such as through a filling port. A closing cap may be used to close the cap system, by sealing a spout portion. For example, a portion of the cap system may be configured to selectably screw onto the fitment of a flexible pouch (e.g., or be integrated with the fitment), and another portion may be configured to selectably screw into a filling port of an outdrive of a marine motor; and used to transfer lubricant from the pouch into the outdrive.

In one implementation, a device, which may be used for coupling with a packaging opening to facilitate transfer of contents from the packaging to a target system, can comprise a base cap. The base cap may comprise a base portion configured to selectably engage with a package opening, and a nozzle portion that comprises a first engagement portion and a second engagement portion. In this implementation, the second engagement portion can be configured to selectably engage with a filling port of a target device. Additionally, the device can comprise a closing cap that is configured to selectably engage with the first engagement portion of the nozzle portion to provide a seal for the package opening when the base cap is engaged with the package opening and the closing cap is engaged with the first engagement portion.

In another implementation, the device may be configured to fixedly engage with a packaging opening to facilitate transfer of contents from the packaging to a target system. A base portion may be configured to fixedly engage with a package opening. In this implementation, a nozzle portion can comprises a first engagement portion and a second engagement portion. In this implementation, the second engagement portion can be configured to selectably engage with a filling port of a target device. Additionally, the device can comprise a closing cap that is configured to selectably engage with the first engagement portion of the nozzle portion to provide a seal for the package opening when the base portion is engaged with the package opening and the closing cap is engaged with the first engagement portion.

To the accomplishment of the foregoing and related ends, the following description and annexed drawings set forth certain illustrative aspects and implementations. These are indicative of but a few of the various ways in which one or more aspects may be employed. Other aspects, advantages and novel features of the disclosure will become apparent from the following detailed description when considered in conjunction with the annexed drawings.

BRIEF DESCRIPTION OF THE DRAWINGS

What is disclosed herein may take physical form in certain parts and arrangement of parts, and will be described in detail in this specification and illustrated in the accompanying drawings which form a part hereof and wherein:

FIGS. 3A-3E are component diagrams illustrating various views of one or more portions of an example cap fitting in accordance one or more portions of devices described herein.

DETAILED DESCRIPTION

Figure 1A:
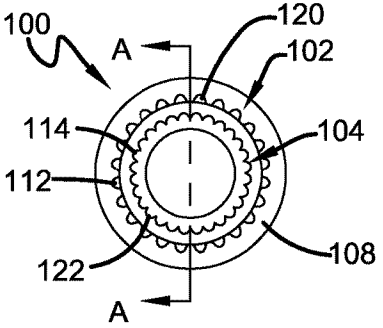
FIGS. 1A-1D are component diagrams illustrating various views of one or more portions of an example cap fitting in accordance one or more portions of devices described herein.

The claimed subject matter is now described with reference to the drawings, wherein like reference numerals are generally used to refer to like elements throughout. In the following description, for purposes of explanation, numerous specific details are set forth in order to provide a thorough understanding of the claimed subject matter. It may be evident, however, that the claimed subject matter may be practiced without these specific details. In other instances, structures and devices may be shown in block diagram form in order to facilitate describing the claimed subject matter.

Figure 1B:
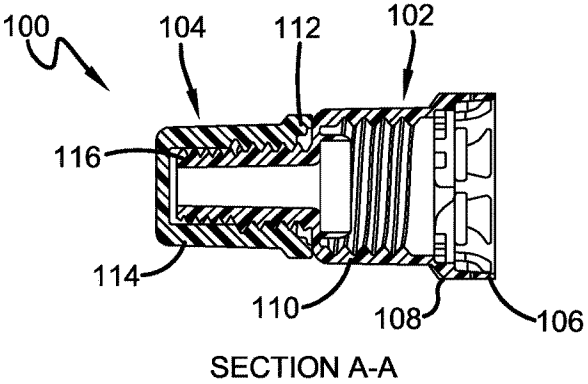
Figure 1C:
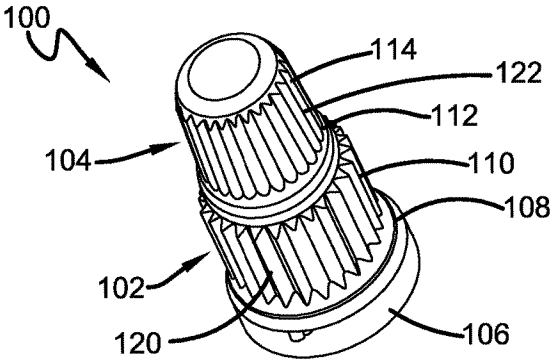
Figure 1D:
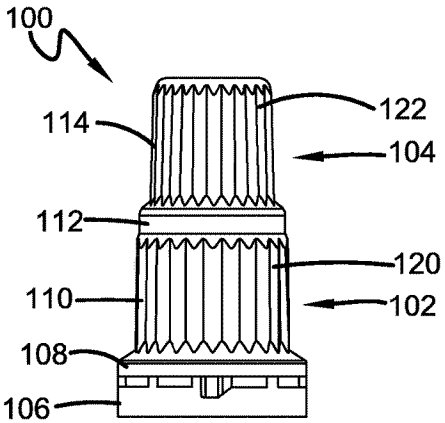

FIGS. 1A, 1B, 1C, and 1D are component diagrams that illustrate an exemplary cap device 100 in various views, such as a top view in FIG. 1A, a lateral section view in FIG. 1B, a perspective view in FIG. 1C, and a side elevation view in FIG. 1D. In this implementation, the exemplary cap device 100 may be used in conjunction with a packaging opening, such as a fitment opening on a pouch. That is, for example, packaging for a liquid may comprise a fitment as a spout for releasing (e.g., or filling) the liquid, and the exemplary cap device 100 may be used to close (e.g., seal) the spout for the package.

In the FIGS. 1A-1D, the exemplary cap device 100 can comprise a base cap 102 and a closing cap 104. The base cap 102 can be configured to selectably engage with an opening of packaging. As an illustrative example, as illustrated in FIGS. 4 and 5, the base cap 102 may be configured to selectably engage with a fitment 150 that is fixedly engaged with (e.g., welded in) an opening 154 in a packaging item 152 (e.g., plastic pouch). Further, the closing cap (e.g., aka a sealing cap) 104 can be configured to selectably engage with at least a portion of the base cap 102. In one implementation, the closing cap 104 can be configured to selectably engage with a nozzle 116 portion of the base cap 102, for example, where the nozzle 116 comprises and opening that may be closed by selectably engaging the closing cap 104 onto the nozzle 116.

Figure 7:
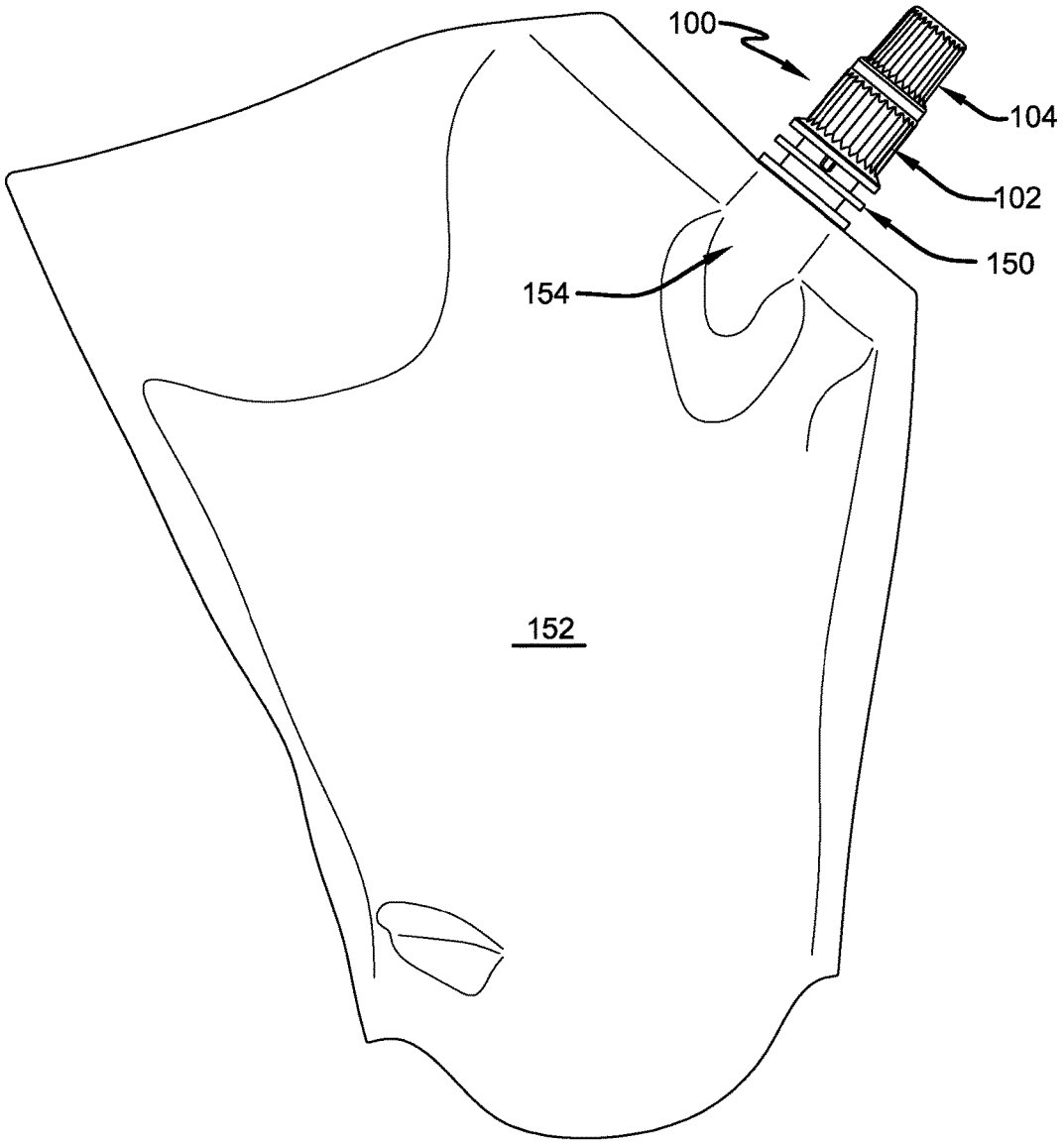
FIG. 7 is an illustration of an example implementation of one or more portions of one or more devices described herein.
Figure 8:
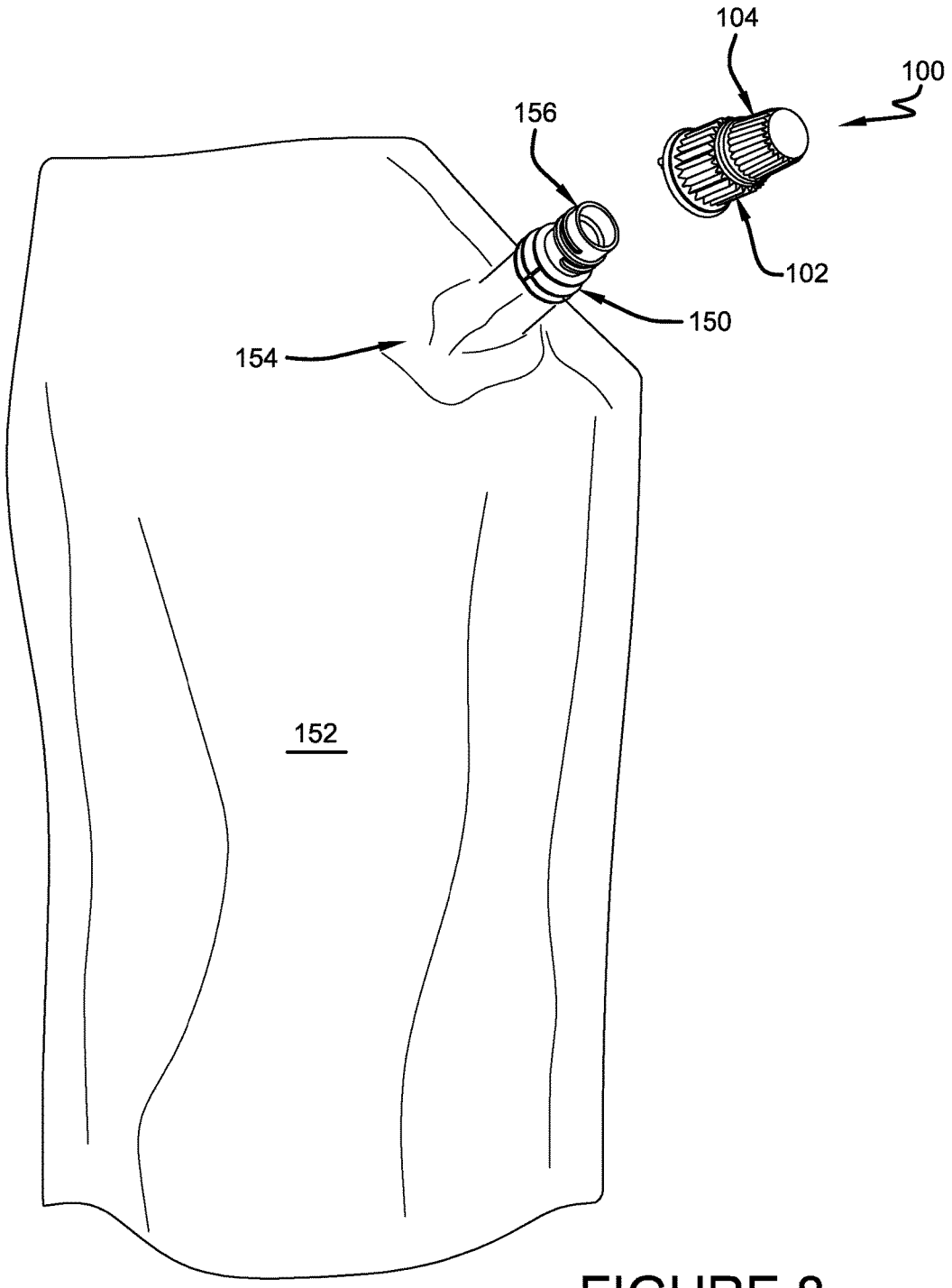
FIG. 8 is an illustration of an example implementation of one or more portions of one or more devices described herein.

In one implementation, the exemplary cap device 100 can comprise an indicator ring 106. An indicator ring can be configured to provide an indication to a user of the device that, at least, the base cap has been tampered with after the device was installed on the packaging. That is, for example, the cap device 100 can be installed on the opening, such as is illustrated in FIG. 7. Subsequently, in this example, if the base cap 102 is removed, as illustrated in FIG. 8, the indicator ring 106 can provide an indication that the base cap 102 has been removed. In this implementation, the indicator ring 106 may detach from the base cap 102 if the base cap 102 is removed from the packaging after the cap device has been installed.

In one implementation, the base cap 102 can comprise a base shoulder portion 108, that can be configured to selectably engage with a shoulder portion of a packaging opening, such as a fitment. Further, the base cap 102 can comprise a body portion 110 that is configured to selectably receive the fitment (e.g., 150 of FIGS. 7 and 8) engaged with the packaging (e.g., 152 of FIGS. 7 and 8). In one implementation, an exterior portion of the body portion 110 can comprise base grip elements 120, such as grooves and ridges, which may be configured to facilitate a grip of the cap by a user.

In one implementation, the closing cap 104, or sealing cap can comprise a cap shoulder portion 112, that can be configured to selectably engage with a top of the base cap 102, for example, in order to provide a desired sealing arrangement (e.g., to mitigate fluid leakage from the packaging). Further, the closing cap 104 can comprise a cap body portion 114 that is configured to selectably receive a nozzle portion 116 of the base cap 102. In one implementation, an exterior portion of the cap body portion 114 can comprise grip elements 122, such as grooves and ridges, which may be configured to facilitate a grip of the cap by a user.

Figure 2B:
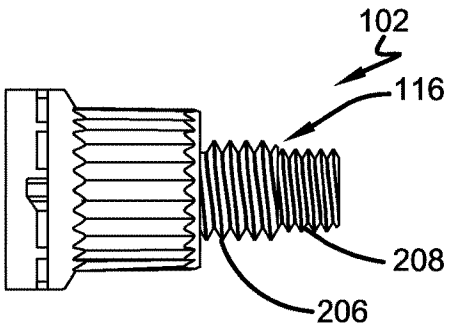
FIGS. 2A-2E are component diagrams illustrating various views of one or more portions of an example cap fitting in accordance one or more portions of devices described herein.
Figure 2E:
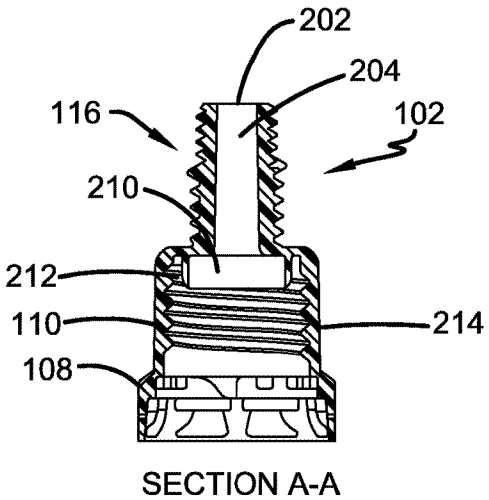
Figure 2D:
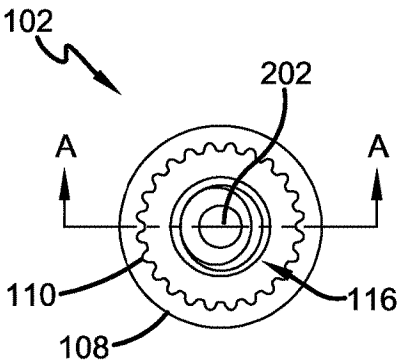
Figure 2A:
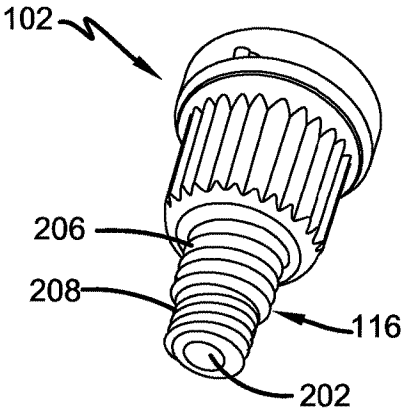
Figure 2C:
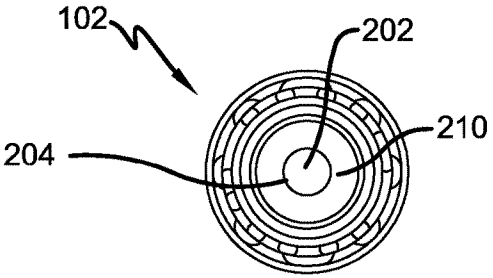

With continued reference to FIGS. 1A-1D, FIGS. 2A, 2B, 2C, 2D, and 2E are component diagrams that illustrate one implementation of the base cap 102 portion of the exemplary cap device 100 in various views, such as a perspective view in FIG. 2A, a side view in FIG. 2B, a bottom in FIG. 2C, a top view in FIG. 2D, and a lateral section view in FIG. 2E. In this implementation, for example, base cap 102 portion comprises the nozzle portion 116. The nozzle portion 116 comprises a spout 204, comprising a spout opening 202 at its distal end. Further, the spout 204 is fluidly coupled with a package fitment receiver 210, which is configured to receive contents from the package fitment when the base cap 102 is operably coupled with the fitment of the packaging (e.g., 150 and 152 of FIGS. 7 and 8). In one implementation, the package fitment receiver 210 can comprise an extension 212 that is configured to selectably engage with a wall of the fitment, for example, to provide a desired seal to mitigate leakage of package contents during transfer out of the package.

In one implementation, the body portion 110 of the base cap 102 can comprise base internal threads 214 (e.g., female threads) that are configured to selectably engage with corresponding external threads (e.g., male threads) disposed on an exterior of a fitment (e.g., engaged with packaging). In this way, the base cap can be selectably engaged with, and removed from, the fitment; and may provide a desired seal when transferring content of the packaging, for example.

Further, the nozzle portion 116 of the base cap 102 can comprise a first engagement portion 206 and a second engagement portion 208.

In one implementation, the first engagement portion 206 can comprise a first threaded portion 206 that can be configured to selectably engage with the closing cap 104. As illustrated in FIGS. 3A, 3B, 3C, 3D, and 3E, with continued reference to FIGS. 1A-1D and 2A-2E, in this implementation, the closing cap 104 can comprise a cap internal threaded portion 302. In one implementation, the closing cap 104 may also comprise a cap internal non-threaded portion 304. The internal threaded portion 302 can be configured to selectably engage with the first threaded portion 206 of the nozzle portion 116 of the base cap 102. That is, for example, the first threaded portion 206 can correspond to an internal threaded portion 302 of the closing cap 104 (e.g., having a same/complementary thread pattern). Further, in one implementation, the internal non-threaded portion 304 can be configured to receive the second engagement portion 208, which may comprise a second threaded portion 208 of the nozzle 116. That is, for example, the internal dimensions of the internal non-threaded portion 304 can be sized to allow the second threaded portion 208 to be selectably inserted into, and removed from, the internal non-threaded portion 304, as illustrated in FIG. 1B, without engaging with the threads of the second threaded portion 208.

In one implementation, the first threaded portion 206 can comprise an external thread, comprising a Universal Standard Thread (UST) pattern (e.g., American Standard Thread). In another implementation, the first threaded portion 206 can comprise an external thread, comprising an International Organization for Standardization (ISO) Metric thread pattern (e.g., metric thread). In one implementation, the second threaded portion 208 of the nozzle 116 can comprise an external thread, comprising a UST pattern. In another implementation, the second threaded portion 208 can comprise an external thread, comprising an ISO Metric thread pattern. In another implementation, the external thread of the first threaded portion 206 can comprise an ISO Metric pattern, while the second threaded portion 208 comprises an ISO Metric thread pattern. In another implementation, the external thread of the first threaded portion 206 can comprise a UST thread pattern, while the second threaded portion 208 comprises a UST thread pattern. As such, the cap device 100 may comprise multiple thread patterns simultaneously to be universally adapted for use.

In one implementation, the cap device 100 may have only the first threaded portion 206, which may be either a UST pattern or an ISO Metric thread pattern. In such a configuration, the base cap 102 may comprise the base portion, which may be configured to selectably engage with a package opening. The base cap 102 may also include the nozzle 116 portion which may comprise the first engagement portion 206 which may be configured to selectably engage with the filling port of the target device. The closing cap 104 may selectably engage with the first threaded portion 206.

FIGS. 4A-D, 5A-E, and 6A-E illustrate another implementation of an example cap device 400. The exemplary cap device 400 can comprise a base cap 402 and a closing cap 404. The base cap 402 can be configured to selectably engage with an opening of packaging. As an illustrative example, as illustrated in FIGS. 4 and 5, the base cap 402 may be configured to selectably engage with a fitment 150 that is fixedly engaged with (e.g., welded in) an opening 154 in a packaging item 152 (e.g., plastic pouch). Further, the closing cap 404 can be configured to selectably engage with at least a portion of the base cap 402. In one implementation, the closing cap 404 can be configured to selectably engage with a nozzle 416 portion of the base cap 402, for example, where the nozzle 416 comprises and opening that may be closed by selectably engaging the closing cap 404 onto the nozzle 416.

In one implementation, the exemplary cap device 400 can comprise a base indicator ring 406. An indicator ring can be configured to provide an indication to a user of the device that, at least, the base cap has been tampered with after the device was installed on the packaging. That is, for example, the cap device 400 can be installed on the opening, such as is illustrated in FIG. 7. Subsequently, in this example, if the base cap 402 is removed, as illustrated in FIG. 8, the base indicator ring 406 can provide an indication that the base cap 402 has been removed. In this implementation, the base indicator ring 406 may detach from the base cap 402 if the base cap 402 is removed from the packaging after the cap device has been installed.

Further, in this implementation, the closing cap 404 can comprise a cap indicator ring 426, which can be configured to provide an indication to a user of the device that, at least, the base cap has been tampered with after the device was installed on the packaging. Much like the indicator ring 406, when the closing cap 404 is removed from the cap device 400, the cap indicator ring 426 may detach from the closing cap 404. Additionally, the base cap 402 can comprise a nozzle portion 416, on which is disposed a nozzle shoulder 424 configured to selectably engage with the cap indicator ring 426. The nozzle shoulder 424 can comprise one or more cap locks 512, configured to engage the cap indicator ring 426 with the nozzle shoulder 424, such that the closing cap 404 is substantially locked in place with the nozzle shoulder 424 when the closing cap 404 is installed. In one implementation, when the closing cap 404 is removed (e.g., unscrewed) the cap locks act to retain the cap indicator ring 426 in place, which, in turn results in the cap indicator ring being uncoupled from the closing cap 404 (e.g., indicating the cap has been tampered with).

In one implementation, the base cap 402 can comprise a base shoulder portion 408, that can be configured to selectably engage with a shoulder portion of a packaging opening, such as a fitment. Further, the base cap 402 can comprise a body portion 410 that is configured to selectably receive the fitment (e.g., 150 of FIGS. 7 and 8) engaged with the packaging (e.g., 152 of FIGS. 7 and 8). In one implementation, an exterior portion of the body portion 410 can comprise grip elements 420, such as grooves and ridges, which may be configured to facilitate a grip of the cap by a user.

In one implementation, the closing cap 404 can comprise a cap shoulder portion 412, that can be configured to selectably engage with a top of the base cap 402, for example, in order to provide a desired sealing arrangement (e.g., to mitigate fluid leakage from the packaging). Further, the closing cap 404 can comprise a cap body portion 414 that is configured to selectably receive a nozzle portion 416 of the base cap 402. In one implementation, an exterior portion of the cap body portion 414 can comprise grip elements 422, such as grooves and ridges, which may be configured to facilitate a grip of the cap by a user.

Figure 4B:
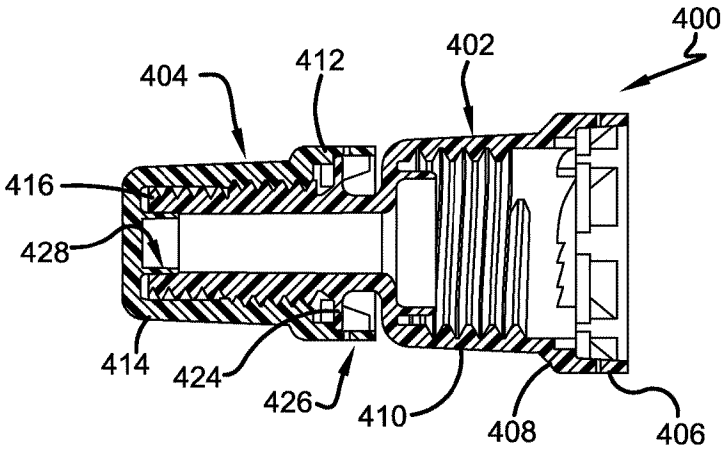
FIGS. 4A-4D are component diagrams illustrating various views of one or more portions of an example cap fitting in accordance one or more portions of devices described herein.
Figure 4D:
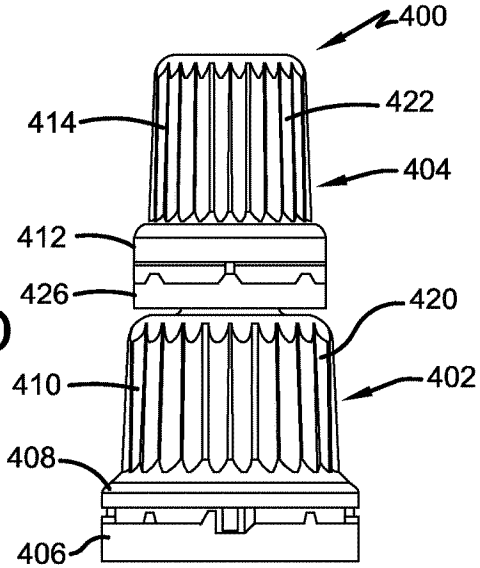
Figure 4A:
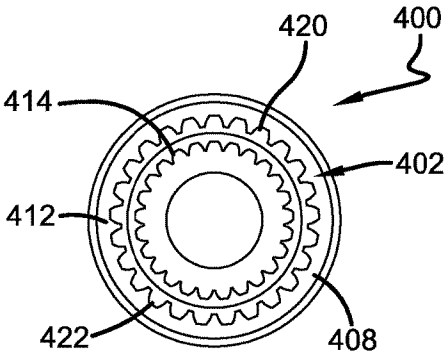
Figure 4C:
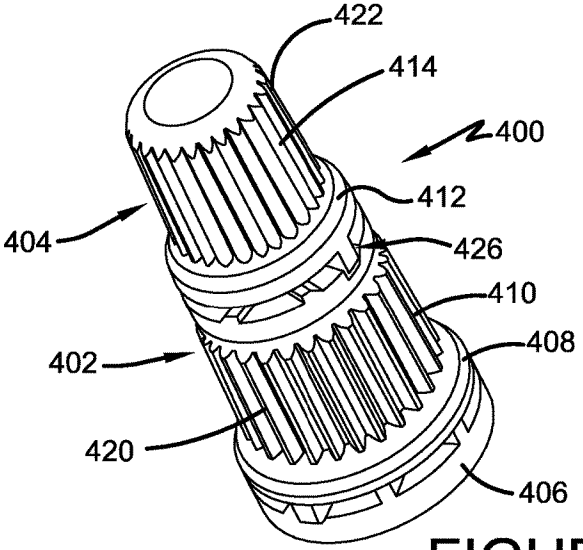
Figure 5B:
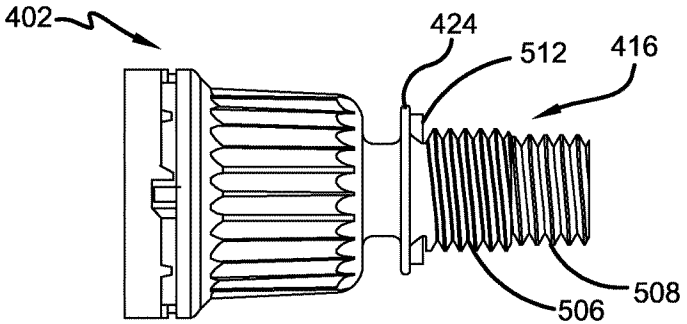
FIGS. 5A-5E are component diagrams illustrating various views of one or more portions of an example cap fitting in accordance one or more portions of devices described herein.
Figure 5E:
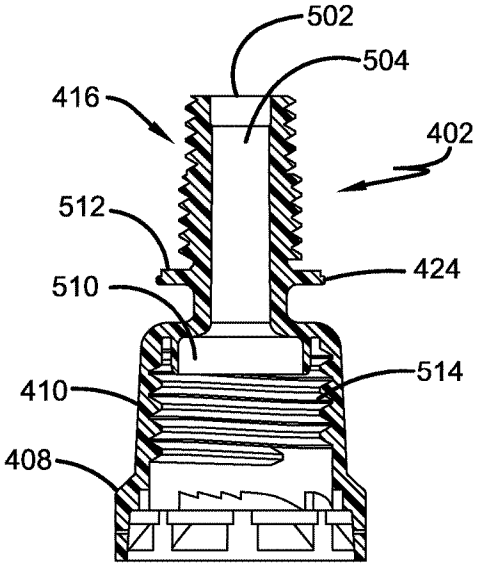
Figure 5D:
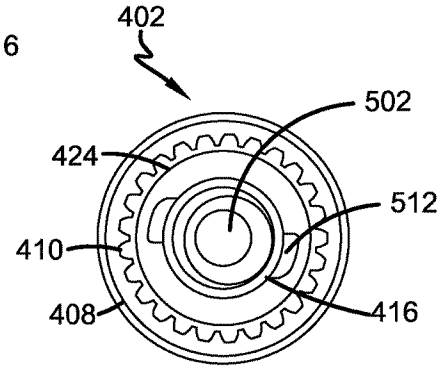
Figure 5A:
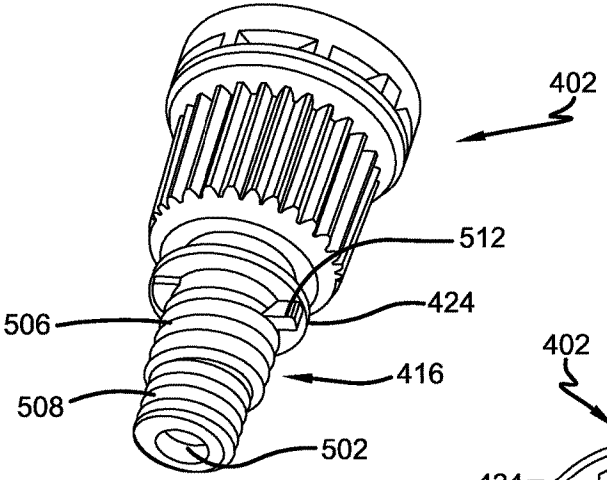
Figure 5C:
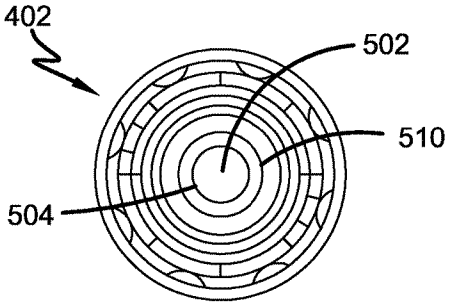

With continued reference to FIGS. 4A-4D, FIGS. 5A, 5B, 5C, 5D, and 5E are component diagrams that illustrate one implementation of the base cap 402 portion of the exemplary cap device 400 in various views, such as a perspective view in FIG. 5A, a side view in FIG. 5B, a bottom in FIG. 5C, a top view in FIG. 5D, and a lateral section view in FIG. 5E. In this implementation, for example, base cap 402 portion comprises the nozzle portion 416. The nozzle portion 416 comprises a spout 504, comprising a spout opening 502 at its distal end. Further, the spout 504 is fluidly coupled with a package fitment receiver 510, which is configured to receive contents from the package fitment when the base cap 402 is operably coupled with the fitment of the packaging (e.g., 150 and 152 of FIGS. 7 and 8). In one implementation, the package fitment receiver 510 can comprise an extension that is configured to selectably engage with a wall of the fitment, for example, to provide a desired seal to mitigate leakage of package contents during transfer out of the package.

In one implementation, the body portion 410 of the base cap 402 can comprise base internal threads 514 (e.g., female threads) that are configured to selectably engage with corresponding external threads (e.g., male threads) disposed on an exterior of a fitment (e.g., engaged with packaging). In this way, the base cap can be selectably engaged with, and removed from, the fitment; and may provide a desired seal when transferring content of the packaging, for example. Further, the nozzle portion 416 of the base cap 402 can comprise a first engagement portion 506 and a second engagement portion 508.

In one implementation, the first engagement portion 506 can comprise a first threaded portion 506 that can be configured to selectably engage with the closing cap 404. As illustrated in FIGS. 6A, 6B, 6C, 6D, and 6E, with continued reference to FIGS. 4A-4D and 5A-5E, in this implementation, the closing cap 404 can comprise a cap internal threaded portion 602. In one implementation, the closing cap 404 may also comprise a cap internal non-threaded portion 604. The internal threaded portion 602 can be configured to selectably engage with the first threaded portion 506 of the nozzle portion 416 of the base cap 402. That is, for example, the first threaded portion 506 can correspond to an internal threaded portion 602 of the closing cap 404 (e.g., having a same/complementary thread pattern). Further, in one implementation, the internal non-threaded portion 604 can be configured to receive the second engagement portion 508, which may comprise a second threaded portion 508 of the nozzle 416. That is, for example, the internal dimensions of the internal non-threaded portion 604 can be sized to allow the second threaded portion 508 to be selectably inserted into, and removed from, the internal non-threaded portion 604, as illustrated in FIG. 4B, without engaging with the threads of the second threaded portion 508.

Figure 6B:
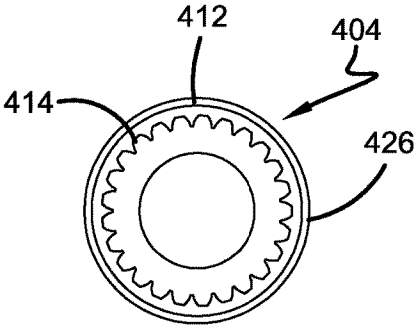
FIGS. 6A-6E are component diagrams illustrating various views of one or more portions of an example cap fitting in accordance one or more portions of devices described herein.
Figure 6E:
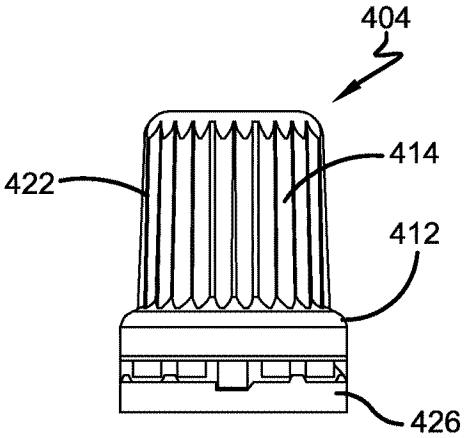
Figure 6C:
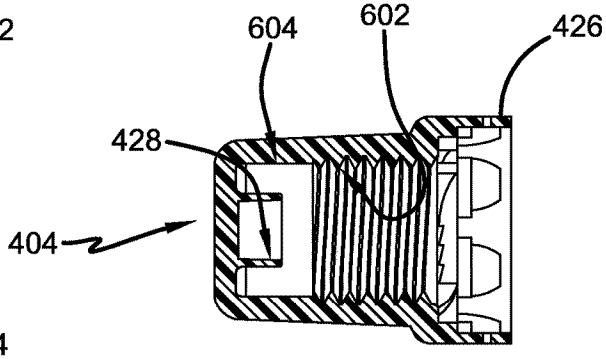
Figure 6A:
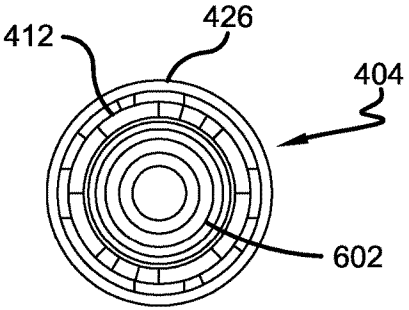
Figure 6D:
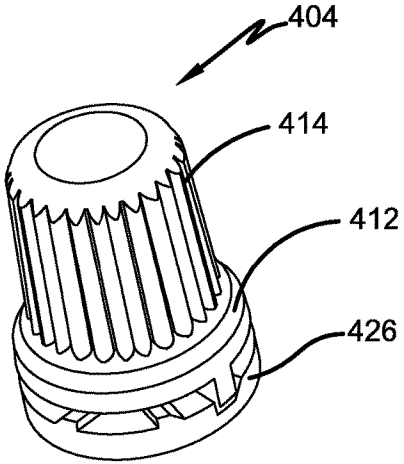

As illustrated in FIGS. 4B and 6C, the closing cap 404 can comprise a nozzle engaging closure 428, which is configured to selectably engage with the spout 504, at the spout opening 502 at the distal end of the nozzle 416. In this implementation, the nozzle engaging closure 428 can be sized to fit into the spout 504 at the spout opening 502, to provide a type of seal to mitigate fluid leakage, when the closing cap 404 is engaged with the base cap 402.

Figure 9:
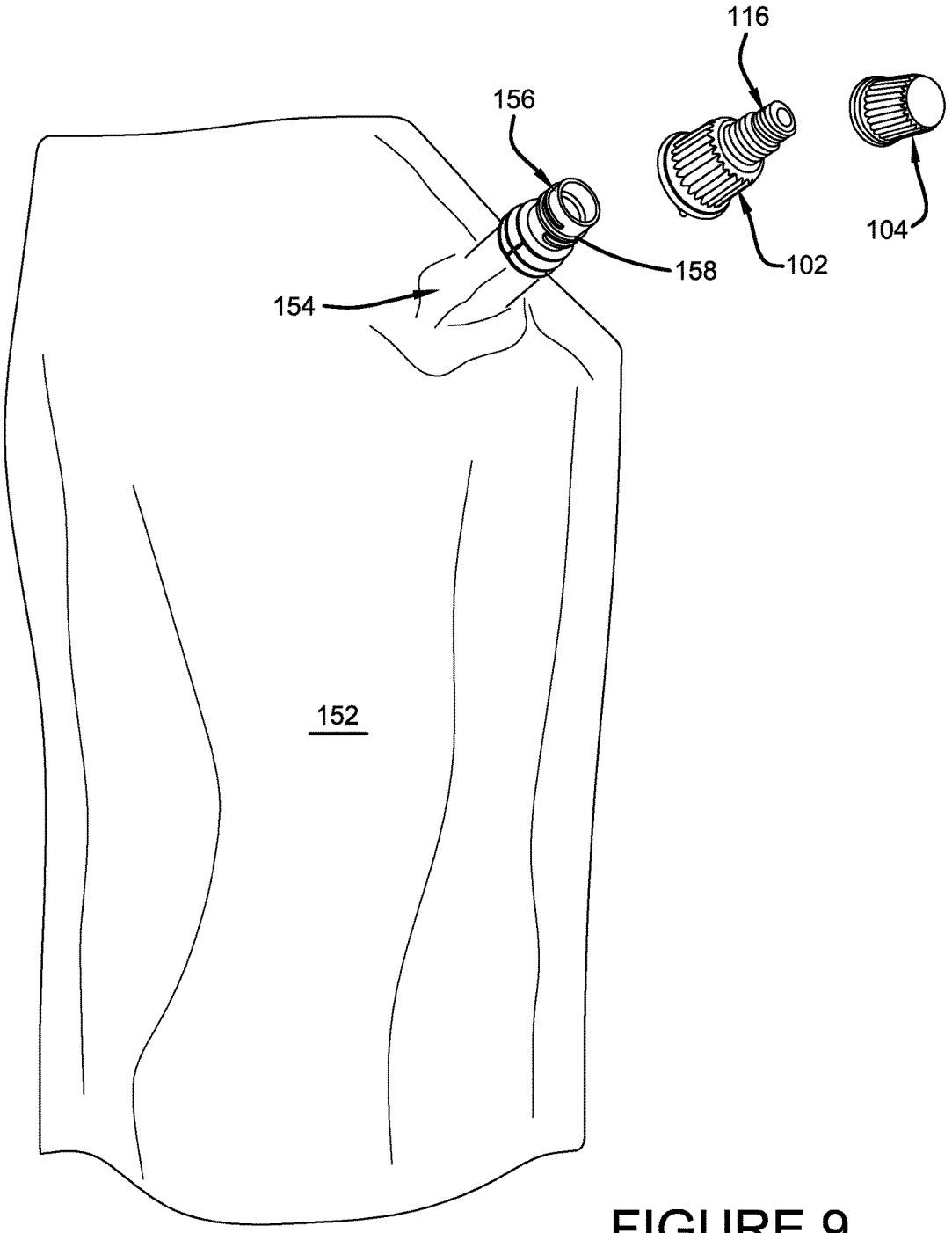
FIG. 9 is an illustration of an example implementation of one or more portions of one or more devices described herein.
Figure 10:
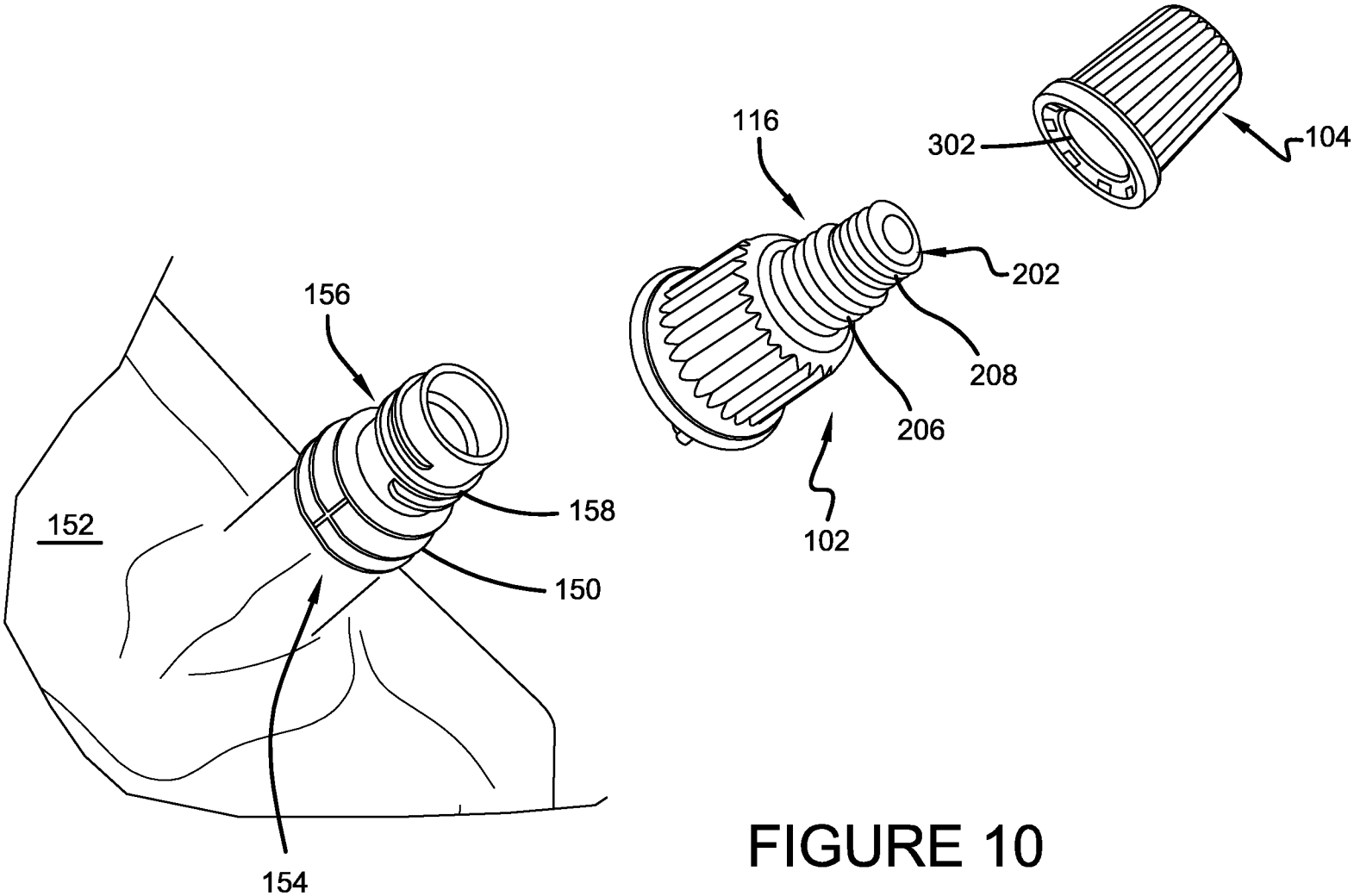
FIG. 10 is an illustration of an example implementation of one or more portions of one or more devices described herein.
Figure 11:
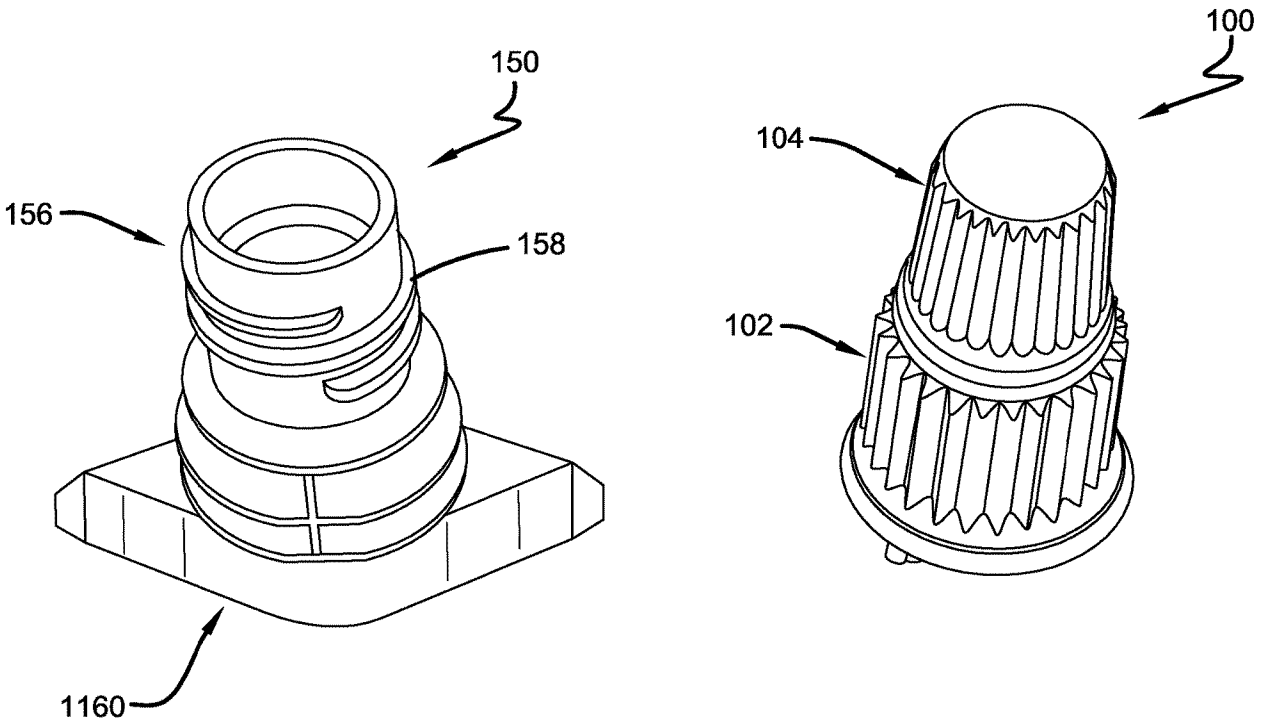
FIG. 11 is an illustration of an example implementation of one or more portions of one or more devices described herein.
Figure 12B:
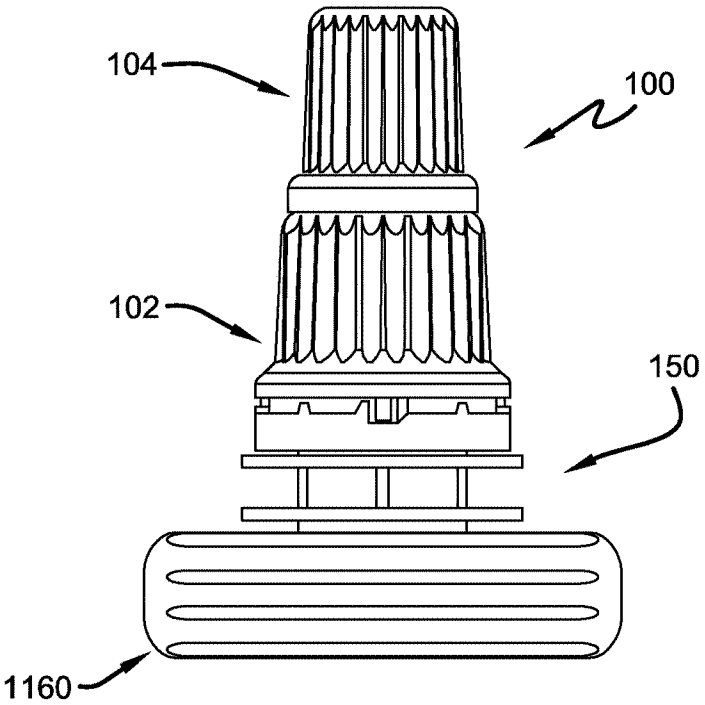
FIGS. 12A and 12B are component diagrams illustrating side views of one or more portions of an example implementation of the cap fitting in accordance one or more portions of devices described herein.
Figure 12A:
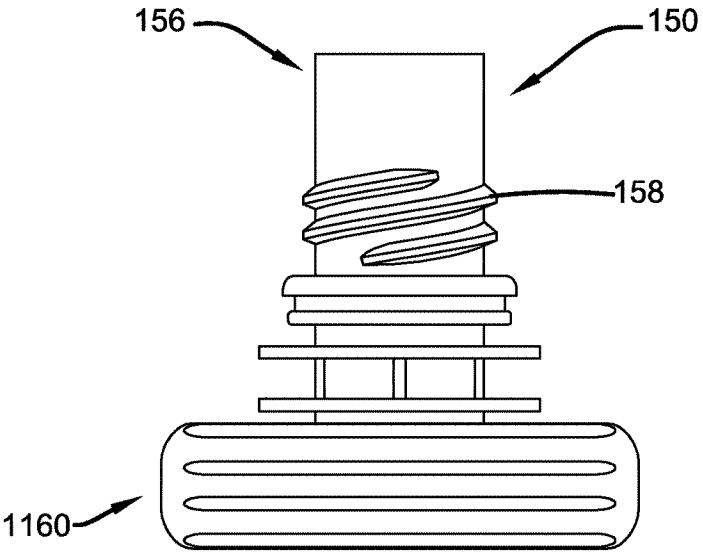

As an illustrative example, as illustrated in FIGS. 9 and 10, the closing cap 104 can be selectably removed from the nozzle portion 116 of the base cap 102. In this example, the first threaded portion 206 of the nozzle 116 comprises a different thread pattern than that of the second threaded portion 208. The closing cap 104 is configured to selectably engage with the first threaded portion 206, for example, which can be used to effectively close (e.g., seal) the spout opening 202. In one implementation, the first threaded portion 206 may be configured to selectably couple with first target device (not shown). That is, for example, the first threaded portion 206 may be configured to selectably engage with a device that may receive contents from the attached package (e.g., pouch), through the fitment 150 in package opening 154, and out the spout opening 202. In this way, for example, the contents of the package 152 may be less likely to spill outside of the target device, as the nozzle portion 116 of the base cap 102 can be sealed to the first target device by threaded engagement.

Further, in one implementation, the first threaded portion 206 of the nozzle 116 can comprise a different outer diameter than the second threaded portion 208 of the nozzle 116. In this implementation, for example, the second threaded portion 208 of the nozzle 116 can comprise a diameter and thread pattern that is configured to selectably, threadedly engage with a filling port of a second target device. In this example, the filling port can comprise complementary internal threading to receive the external threading of the second threaded portion 208. Further, the second threaded portion 208 can be so dimensioned (e.g., lengthwise) that merely a desired length of the nozzle 116 engages with the target device port, for example, and does not extend too far to impeded loading of the package contents into the port, but engages sufficiently to mitigate unplanned or accidental disengagement of the nozzle 116 from the port.

In one implementation, the packaging 152 engaged with the fitment 150, which is engaged with the base cap 102, can comprise a flexible packaging configured to release its contents when pressure is applied to the outside of the packaging. That is, for example, the packaging may be a flexible pouch (e.g., made of a type of plastic, metalized plastic, polymer, or other flexible packaging), which compresses the stored contents, forcing them out the fitment opening, when pressure is applied to the outside of the pouch (e.g., the pouch is squeezed). In this way, for example, when the base cap 102 is threadedly engaged with a spout portion 156 of the fitment 150, and the closing cap 104 is removed from the nozzle 116, the pouch contents can be forced out the spout opening 202. If the second threaded portion 208 is engaged with the port of the device, the pouch contents can be forced into the device through the port, in this example.

As an example, some systems, devices and apparatus, may utilize fluid (e.g., lubricants) be installed in a manner that mitigates intrusion of air. That is, some lubricants are desired to be forced into a port of the system in a manner that does not allow air to introduced, such as outdrive components of boat motors, and other systems in which air intrusion can lead to undesired operation. As an example, when installing lubricant into the lower gear unit of a boat's outdrive, manufacturers recommend filling the lubricant from a bottom port, at least until the lubricant reaches a top port. In this example, this type of filling operation mitigates a chance of air being introduced into the lower unit.

As illustrated in FIGS. 7, 8, 11, 12A and 12B, as an illustrative example, a fitment 150, comprising a spout portion 156, can be installed in an opening 154 of a packaging pouch 152. As an example, a packaging engagement portion 1160 of the fitment 150 may be fixedly coupled (e.g., welded, glued, etc.) to the package opening 154 of the packing pouch 152. Additionally, the packaging pouch 152 can be filled with a desired fluid, such as a lubricant (e.g., or other fluid), for example, either through the spout portion 156 of the fitment 150, or through a second opening (not shown) in the packaging 152 (e.g., which can be subsequently sealed). Further, in this example, the exemplary cap 100 can be threadedly engaged with a threaded portion 158 of the fitment 150, effectively sealing the fluid contents inside the pouch 152.

As illustrated in FIGS. 9 and 10, for example, when the user desires, the closing cap 104 may be selectably removed from threaded engagement with the first threaded portion 206 of the nozzle 116 of the base cap 102. Additionally, in this example, the second threaded portion 208, which is configured to selectably engage with the lower port of the lower gear unit of the boat outdrive, can be threadedly engaged with the lower port, thereby sealing the pouch 152 to the lower port. Alternatively, the base cap 102 can be removed from the fitment, and threadedly engaged with the lower port, and the fitment can subsequently be threadedly engaged with the base cap 102 that is engaged with the lower port.

In this example, with the exemplary cap fluidly coupling the lubricant contents of the pouch to the lower port, a user can apply pressure to the pouch 152, which can result in the lubricant contents being forced into the lower unit in the desired manner. In this way, spillage of the lubricant is mitigated, and introduction of air into the system is also reduced. In one implementation, the packaging may comprise merely sufficient amounts of the contents (e.g., lubricant) to complete the target task (e.g., fill the reservoir for the lower unit). That is, for example, the pouch can be configured in different sizes to accommodate different filling needs, where a first filling need may utilize a first amount of fluid and a second filling need may utilize a second amount of fluid. In this example, fluid may not be wasted, such as when there is more fluid in the pouch than needed for a filling job; and/or the user may not need to change pouches to obtain additional fluid to finish the filling job, such as when a pouch has less than is needed for the target job.

As an illustrative example, the cap system can be configured to selectably couple with (e.g., thread onto) a fitment that is sealably engaged with a package, such as a flexible pouch. In this example, the cap system has a first portion (e.g., 110) that can couple with the fitment. It should be appreciated that the cap system can be configured to selectably couple with any size fitment that has been selected for use for a targeted use, and it is anticipated that a plurality of fitment sizes can be accommodated by the systems described here. For example, a first exemplary cap system may be configured to selectably couple with a 10.5 mm fitment, a second exemplary cap system may be configured to selectably couple with a 21.5 mm fitment (e.g., or another size, such as 9 mm, 13 mm, etc.).

FIGS. 13A, 13B, 14A, 14*b*, 15A, and 15B are component diagrams illustrating alternate implementations of one or more portions of the systems described herein. In one aspect, the cap device (e.g., 100) may be integrated into a fitment. For example, a fitment may be configured with the first and second threaded portions (e.g., 206 and 208, respectively of FIG. 2), and the fitment may be fixedly engaged with a desired packaging. In this way, in this aspect, for example, the dual threaded design can be integrated into the fitment, and may not be a separate, adapter-type cap device.

Figure 13B:
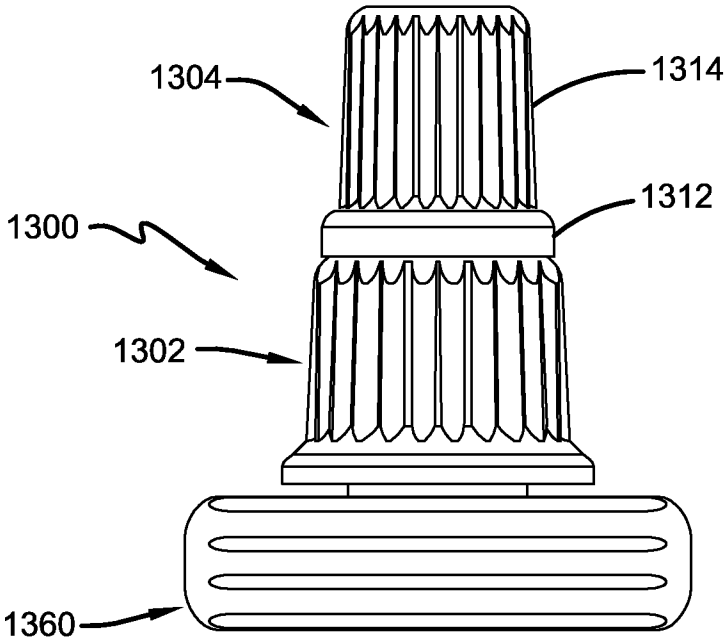
FIGS. 13A and 13B are component diagrams illustrating side views of one or more portions of an example implementation of the integrated cap fitting in accordance one or more portions of devices described herein.
Figure 13A:
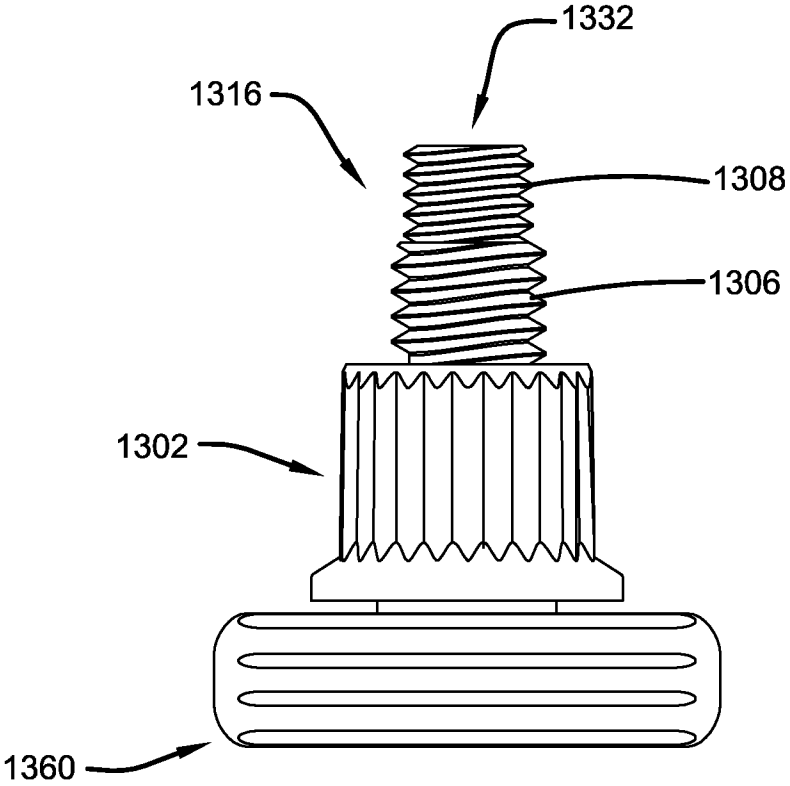
Figure 14B:
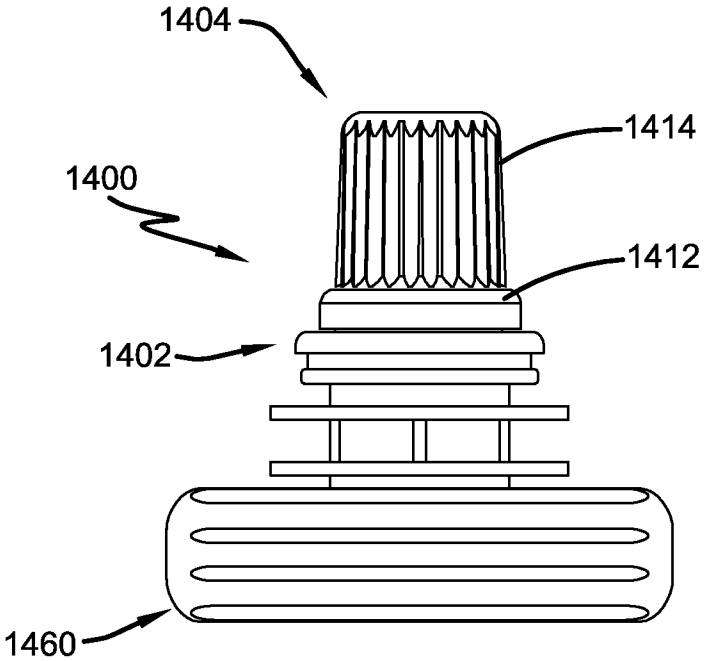
FIGS. 14A and 14B are component diagrams illustrating side views of one or more portions of another example implementation of the integrated cap fitting in accordance one or more portions of devices described herein.
Figure 14A:
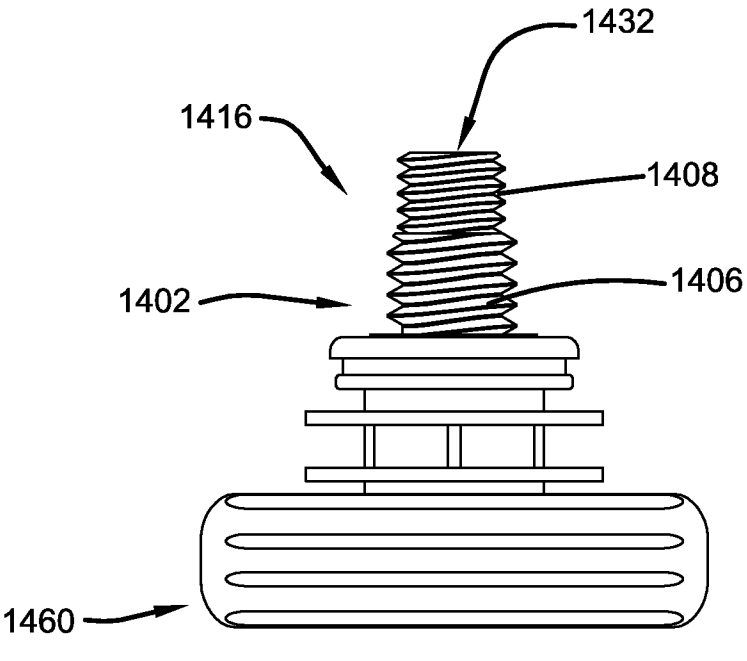

In one implementation, in this aspect, as illustrated in FIGS. 13A and 13B, an integrated fitment system 1300 can comprise a base portion 1302 and a cap 1304. In this implementation, the base portion 1302 can comprise a packaging engagement portion 1360 that can be configured to be fixedly engaged with a desired package, such as a pouch (e.g., 152). As an example, the packaging engagement portion 1360 can be plastic welded or glued (e.g., or some other appropriate sealing and joining means) into a package opening (e.g., 154) of the package, such that a fluid seal is created at the barrier between the integrated fitment system 1300 and the packaging.

Further, the base portion 1302 can comprise a nozzle portion 1316 that can be configured to selectably couple with the cap 1304. In this implementation, the nozzle portion 1316 can comprise a first engagement portion 1306 and a second engagement portion 1308. In one implementation, the first engagement portion 1306 can comprise a first threaded portion 1306 that can be configured to selectably engage with the closing cap 1304. In one implementation, the closing cap 1304 can comprise an internal threaded portion (not shown), and may also comprise a non-threaded internal portion (not shown). The internal threaded portion can be configured to selectably engage with the first threaded portion 1306 of the nozzle portion 1316 of the base cap 1302. That is, for example, the first threaded portion 1306 can correspond to an internal threaded portion of the closing cap 1304 (e.g., having a same/complementary thread pattern). Further, in one implementation, the non-threaded internal portion can be configured to receive the second engagement portion 1308, which may comprise a second threaded portion 1308 of the nozzle 1316. That is, for example, the internal dimensions of the non-threaded internal portion can be sized to allow the second threaded portion 1308 to be selectably inserted into, and removed from, the non-threaded internal portion (e.g., as illustrated in FIG. 1B), without engaging with the threads of the second threaded portion 1308.

In one implementation, the first threaded portion 1306 can comprise an external thread, comprising a Universal Standard Thread (UST) pattern (e.g., American Standard Thread). In another implementation, the first threaded portion 1306 can comprise an external thread, comprising an International Organization for Standardization (ISO) Metric thread pattern (e.g., metric thread). In one implementation, the second threaded portion 1308 of the nozzle 1316 can comprise an external thread, comprising a UST pattern. In another implementation, the second threaded portion 1308 can comprise an external thread, comprising an ISO Metric thread pattern. In another implementation, the external thread of the first threaded portion 1306 can comprise an ISO Metric pattern, while the second threaded portion 1308 comprises an ISO Metric thread pattern. In another implementation, the external thread of the first threaded portion 1306 can comprise a UST thread pattern, while the second threaded portion 1308 comprises a UST thread pattern. As such, the fitment system 1300 may comprise multiple thread patterns simultaneously to be universally adapted for use.

In one implementation, the fitment system 1300 may merely have the first threaded portion 1306, which may be either a UST pattern or an ISO Metric thread pattern. In such a configuration, the base cap 1302 may comprise the base portion, which may be configured to selectably engage with a package opening. The base cap 1302 may also include the nozzle 1316 portion which may comprise the first engagement portion 1306 which may be configured to selectably engage with the filling port of the target device. The closing cap 1304 may selectably engage with the first threaded portion 1306.

As an example, as illustrated in FIGS. 13A and 13B, the closing cap 1304 can be selectably removed from the nozzle portion 1316 of the base cap 1302. In this example, the first threaded portion 1306 of the nozzle 1316 comprises a different thread pattern than that of the second threaded portion 1308. The closing cap 1304 is configured to selectably engage with the first threaded portion 1306, for example, which can be used to effectively close (e.g., seal) the spout opening 1332. In one implementation, the first threaded portion 1306 may be configured to selectably couple with a first target device (not shown). That is, for example, the first threaded portion 1306 may be configured to selectably engage with a device that may receive fluid contents from the attached package (e.g., pouch), through the fitment system 1300 disposed in the package opening (e.g., 154), and out through the spout opening 1332. In this way, for example, fluid contents of the package may be less likely to spill outside of the target device, as the nozzle portion 1316 of the base cap 1302 can be substantially sealed to the first target device by threaded engagement.

Further, in one implementation, the first threaded portion 1306 of the nozzle 1316 can comprise a different outer diameter than the second threaded portion 1308 of the nozzle 1316. In this implementation, for example, the second threaded portion 1308 of the nozzle 1316 can comprise a diameter and thread pattern that is configured to selectably, threadedly engage with a filling port of a second target device. In this example, the filling port can comprise complementary internal threading to receive the external threading of the second threaded portion 1308. Further, the second threaded portion 1308 can be so dimensioned (e.g., lengthwise) that merely a desired length of the nozzle 1316 engages with the target device port, for example, and does not extend too far to impeded loading of the package contents into the port, but engages sufficiently to mitigate unplanned disengagement of the nozzle 1316 from the port.

In this implementation, the cap 1304 of the fitment system 1300 can comprise a cap body 1314, a cap shoulder 1312, the internal threaded portion (not shown) and the internal non-threaded portion (described above). The cap body 1314 can be configured to selectably receive the nozzle portion 1316 of the base 1302. In one implementation, an exterior portion of the cap body 1314 can comprise grip elements, such as grooves and ridges, which may be configured to facilitate a grip of the cap by a user. The cap shoulder portion 1312, can be configured to selectably engage with a top of the base cap 1302, for example, in order to provide a desired sealing arrangement (e.g., to mitigate fluid leakage from the packaging).

In one implementation, in this aspect, as illustrated in FIGS. 14A, 14B, 15A, and 15B, an integrated fitment system 1400 can comprise a base portion 1402 and a cap 1404. In this implementation, the base portion 1402 can comprise a packaging engagement portion 1460 that can be configured to be fixedly engaged with a desired package, such as a pouch (e.g., 152). As an example, the packaging engagement portion 1460 can be plastic welded or glued (e.g., or some other appropriate sealing and joining means) into a package opening 1554 of the package, such that a fluid seal is created at the barrier between the integrated fitment system 1400 and the packaging.

Further, the base portion 1402 can comprise a nozzle portion 1416 that can be configured to selectably couple with the cap 1404. In this implementation, the nozzle portion 1416 can comprise a first engagement portion 1406 and a second engagement portion 1408. In one implementation, the first engagement portion 1406 can comprise a first threaded portion 1406 that can be configured to selectably engage with the closing cap 1404. In one implementation, the closing cap 1404 can comprise an internal threaded portion 1534, and may also comprise a non-threaded internal portion 1536. The internal threaded portion 1534 can be configured to selectably engage with the first threaded portion 1406 of the nozzle portion 1416 of the base cap 1402. That is, for example, the first threaded portion 1406 can correspond to the internal threaded portion 1534 of the closing cap 1404 (e.g., having a same/complementary thread pattern). Further, in one implementation, the non-threaded internal portion 1536 can be configured to receive the second engagement portion 1408, which may comprise a second threaded portion 1408 of the nozzle 1416. That is, for example, the internal dimensions of the non-threaded internal portion 1536 can be sized to allow the second threaded portion 1408 to be selectably inserted into, and removed from, the non-threaded internal portion 1536, without engaging with the threads of the second threaded portion 1408.

In one implementation, the first threaded portion 1406 can comprise an external thread, comprising a Universal Standard Thread (UST) pattern (e.g., American Standard Thread). In another implementation, the first threaded portion 1406 can comprise an external thread, comprising an International Organization for Standardization (ISO) Metric thread pattern (e.g., metric thread). In one implementation, the second threaded portion 1408 of the nozzle 1416 can comprise an external thread, comprising a UST pattern. In another implementation, the second threaded portion 1408 can comprise an external thread, comprising an ISO Metric thread pattern. In another implementation, the external thread of the first threaded portion 1406 can comprise an ISO Metric pattern, while the second threaded portion 1408 comprises an ISO Metric thread pattern. In another implementation, the external thread of the first threaded portion 1406 can comprise a UST thread pattern, while the second threaded portion 1408 comprises a UST thread pattern. As such, the fitment system 1400 may comprise multiple thread patterns simultaneously to be universally adapted for use.

In one implementation, the fitment system 1400 may have only the first threaded portion 1406, which may be either a UST pattern or an ISO Metric thread pattern. In such a configuration, the base cap 1402 may comprise the base portion, which may be configured to selectably engage with a package opening 1554. The base cap 1402 may also include the nozzle 1416 portion which may comprise the first engagement portion 1406 which may be configured to selectably engage with the filling port of the target device. The closing cap 1404 may selectably engage with the first threaded portion 1406.

As an example, the closing cap 1404 can be selectably removed from the nozzle portion 1416 of the base cap 1402. In this example, the first threaded portion 1406 of the nozzle 1416 comprises a different thread pattern than that of the second threaded portion 1408. The closing cap 1404 is configured to selectably engage with the first threaded portion 1406, for example, which can be used to effectively close (e.g., seal) the spout opening 1432. In one implementation, the first threaded portion 1406 may be configured to selectably couple with a first target device (not shown). That is, for example, the first threaded portion 1406 may be configured to selectably engage with a device that may receive fluid contents from the attached package (e.g., pouch), through the fitment system 1400 disposed in the package opening 1554, and out through the spout opening 1432. In this way, for example, fluid contents of the package may be less likely to spill outside of the target device, as the nozzle portion 1416 of the base cap 1402 can be substantially sealed to the first target device by threaded engagement.

Further, in one implementation, the first threaded portion 1406 of the nozzle 1416 can comprise a different outer diameter than the second threaded portion 1408 of the nozzle 1416. In this implementation, for example, the second threaded portion 1408 of the nozzle 1416 can comprise a diameter and thread pattern that is configured to selectably, threadedly engage with a filling port of a second target device. In this example, the filling port can comprise complementary internal threading to receive the external threading of the second threaded portion 1408. Further, the second threaded portion 1408 can be so dimensioned (e.g., lengthwise) that merely a desired length of the nozzle 1416 engages with the target device port, for example, and does not extend too far to impeded loading of the package contents into the port, but engages sufficiently to mitigate unplanned disengagement of the nozzle 1416 from the port.

In this implementation, the cap 1404 of the fitment system 1400 can comprise a cap body 1414, a cap shoulder 1412, the internal threaded portion 1534 and the internal non-threaded portion 1536. The cap body 1414 can be configured to selectably receive the nozzle portion 1416 of the base 1402. In one implementation, an exterior portion of the cap body 1414 can comprise grip elements, such as grooves and ridges, which may be configured to facilitate a grip of the cap by a user. The cap shoulder portion 1412, can be configured to selectably engage with a top of the base cap 1402, for example, in order to provide a desired sealing arrangement (e.g., to mitigate fluid leakage from the packaging).

Figure 15B:
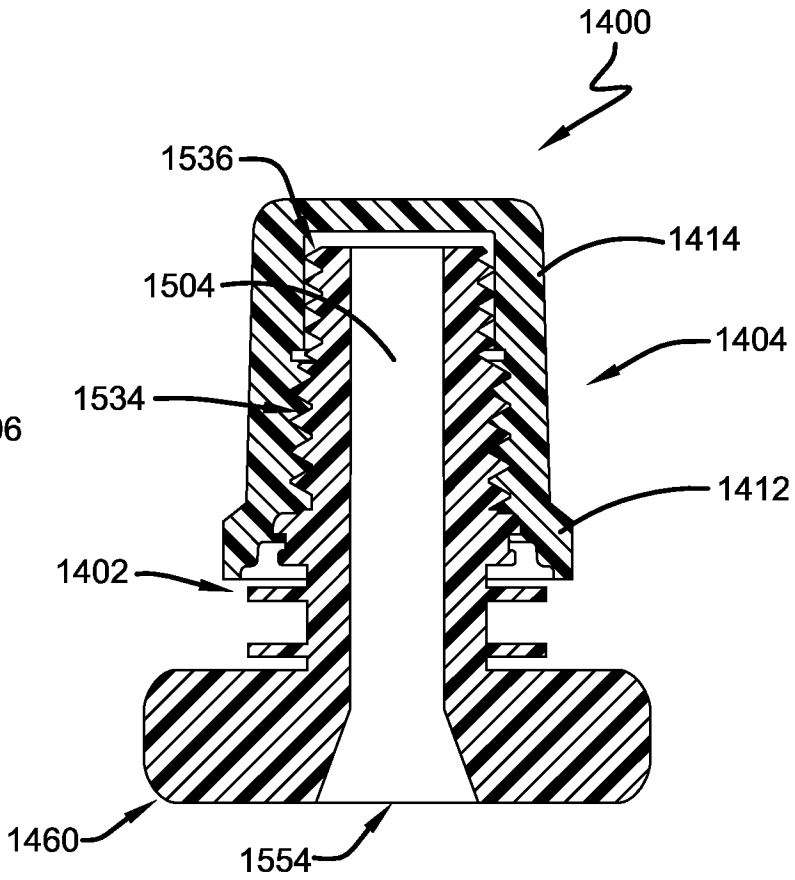
FIGS. 15A and 15B are component diagrams illustrating side cut-away views of one or more portions of another example implementation of the integrated cap fitting in accordance one or more portions of devices described herein.
Figure 15A:
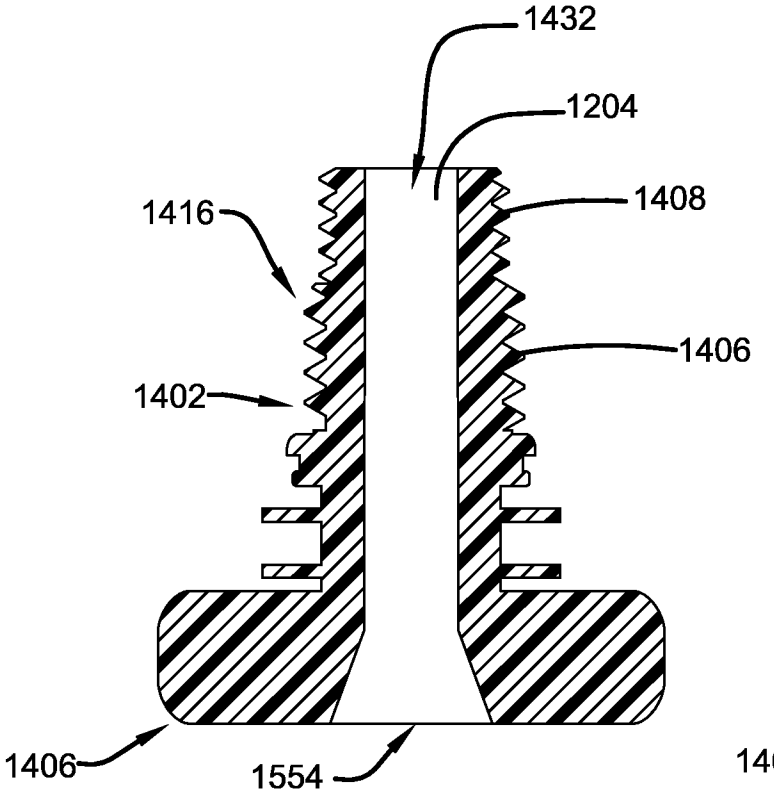

As illustrated in FIGS. 15A and 15B, the fitment system 1400 can comprise a spout 1504. In this implementation, the nozzle portion 1416 comprises the spout 1504, comprising a spout opening 1432 at its distal end. Further, the spout 1504 is fluidly coupled with proximal end of the fitment system 1300, at the area where the packaging engagement portion 1460 can be engaged with the package opening 1554 of the target package. The spout 1504 is configured to receive contents from the package, for example, when the cap 1404 is selectably removed from the base 1402 of the fitment system 1400. In this way, for example, fluid contents of the package can be discharged from the fitment system 1400, through the spout 1504, and out the spout opening 1432 (e.g., into and engaged target device, such as a motor's outdrive).

Further, in this illustrative example, the integrated fitment system 1400 can be configured to selectably couple with (e.g., thread onto) a filling port of a device or machine, such as a lubricant reservoir. In this example, the integrated fitment system 1400 has a second portion (e.g., 208) that can couple with a filling port of a lower unit outdrive of a boat inboard stern drive, and/or the lower unit of a boat outboard motor. For example, the filling port(s) of these types of the lubricant reservoirs can comprise a particular thread design and port size. In this example, the second threaded portion 1408 of the integrated fitment system 1400 can be specifically designed to couple with this type of filling port, creating a substantially leak-tight means for transferring content of the flexible pouch (e.g., gear lube) directly into the lower unit, such as by squeezing the pouch; where the pouch may contain merely the amount of lubricant needed to fill the reservoir to the preferred level.

Figure 16A:
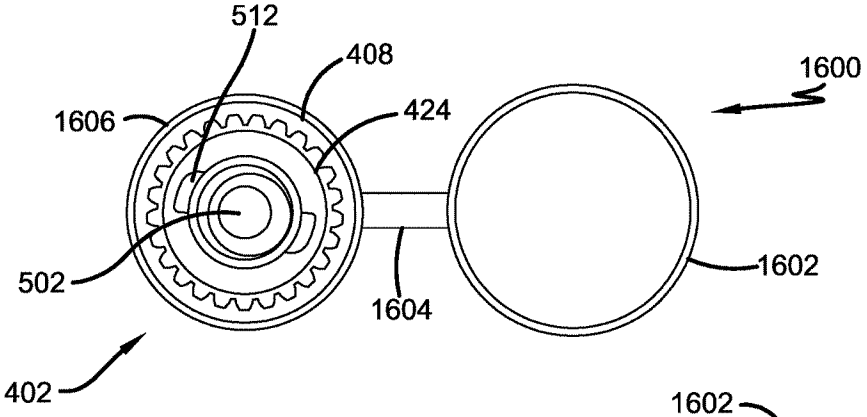
FIGS. 16A, 16B, and 16C are component diagrams illustrating an example implementation of one or more portions of another example implementation of the integrated cap fitting in accordance one or more portions of devices described herein.
Figure 16C:
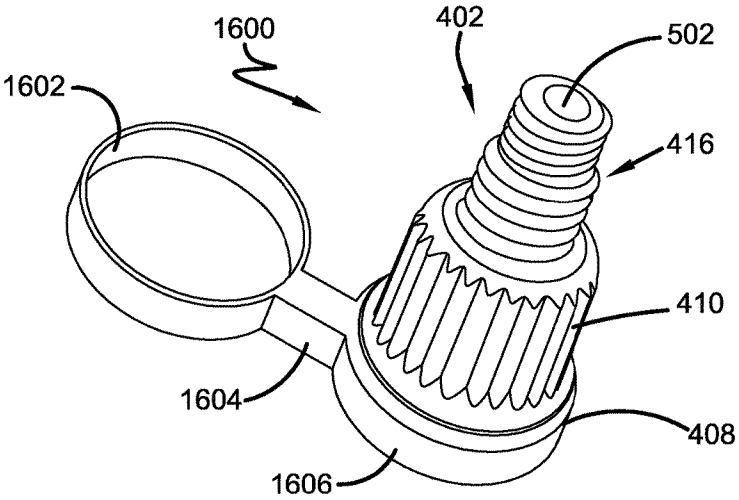
Figure 16B:
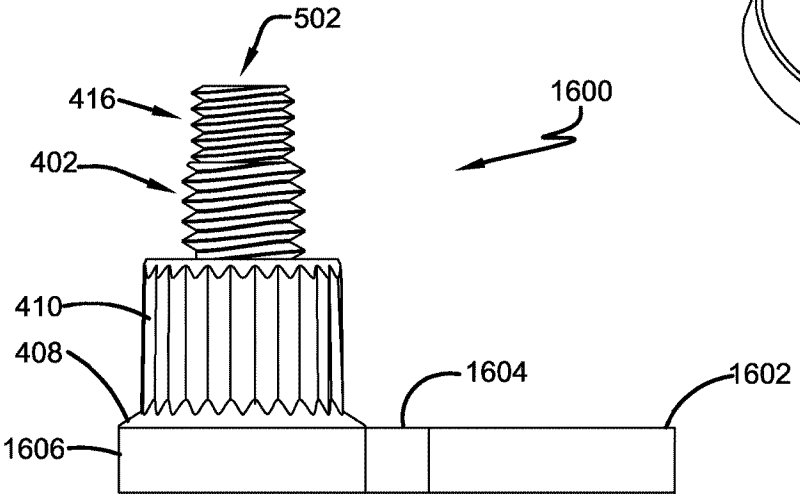

In one aspect, a cap device may comprise a component that allows the cap device to be selectably engaged with a fitment or packaging opening in a non-use disposition, for example, such that a user may select to engage the cap device with the fitment or packaging opening if desired. FIGS. 16A, 16B, and 16C are component diagrams illustrating one example implementation of a cap device 1600 that can be selectably engaged (e.g., and disengaged) from the packaging opening in a non-use disposition. As illustrated, in this implementation, the example cap device 1600 can comprise a package attachment component 1602, such as a ring tab, for example. The package attachment component 1602 can be configured to selectably engage with (e.g., and disengage from) the package opening or fitment. For example, the package attachment component 1602 may be configured to engage with the neck of the fitment 150 shown in FIGS. 7-11, 12A & 12B, 14A & 14B, and 15 A & 15B. Further the example cap device 1600 can comprise an attachment arm 1604, such as a tab arm, configured to couple the package attachment component 1602 with a base attachment neck 1606, such as a base tab attachment, engaged with the base cap 402 of the example cap device 1600. That is, for example, the base cap 402 can comprise the base attachment neck 1606 at its proximal end, which may act as (e.g., or in place of) the base indicator ring (e.g., 406 of FIGS. 4A-4D & 5A-5E).

In one implementation, the base attachment neck 1606 may be fixedly engaged with the base cap 402; and in another implementation, the base attachment neck 1606 may be selectably removable from the base cap 402, such as by tearing away, for example. In one implementation, the package attachment component 1602 may be configured to be selectably detachable from the base cap 402; and, in another implementation, the package attachment component 1602 may be fixedly engaged with the base cap 402, such as through the base attachment neck 1606.

The word "exemplary" is used herein to mean serving as an example, instance or illustration. Any aspect or design described herein as "exemplary" is not necessarily to be construed as advantageous over other aspects or designs. Rather, use of the word exemplary is intended to present concepts in a concrete fashion. As used in this application, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Further, at least one of A and B and/or the like generally means A or B or both A and B. In addition, the articles "a" and "an" as used in this application and the appended claims may generally be construed to mean "one or more" unless specified otherwise or clear from context to be directed to a singular form.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. Reference throughout this specification to "one embodiment" or "an embodiment" means that a particular feature, structure, or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments. Of course, those skilled in the art will recognize many modifications may be made to this configuration without departing from the scope or spirit of the claimed subject matter.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure.

In addition, while a particular feature of the disclosure may have been disclosed with respect to only one of several implementations, such feature may be combined with one or more other features of the other implementations as may be desired and advantageous for any given or particular application. Furthermore, to the extent that the terms "includes," "having," "has," "with," or variants thereof are used in either the detailed description or the claims, such terms are intended to be inclusive in a manner similar to the term "comprising."

What is claimed is:

1. A method of transferring contents within a package to an outdrive of a marine motor, comprising:

using a base cap including a cap body portion having internal threads, a nozzle portion comprising a first engagement portion extending from the cap body portion and having external threads of a first diameter and of a first thread pattern, and a second engagement portion extending from the first engagement portion and having external threads of a second diameter smaller than the first diameter and of a second thread pattern;

attaching the base cap to a fitment opening of the package by mating the internal threads with the fitment opening to provide a sealable engagement between the base cap and the package;

attaching the base cap to a filling port of the outdrive by mating the nozzle portion with the filling port to facilitate transfer of the contents from the package to the outdrive, the filling port being lower than the base cap; and transferring at least a portion of the contents within the package to the outdrive.

2. The method of claim 1, wherein attaching the base cap to the filling port further comprises mating the external threads of one of the first engagement portion and the second engagement portion to the filling port to facilitate transfer of the contents from the package to the outdrive.

3. The method of claim 1, wherein the first thread pattern and the second thread pattern are a same thread type or a different thread type.

4. The method of claim 2, wherein the first thread pattern is a Universal Standard Thread (UST) pattern mateable with a complementary UST pattern of a filling port; and the second thread pattern is an International Organization for Standardization (ISO) Metric thread pattern mateable with a complementary ISO pattern of a filling port.

5. The method of claim 1, wherein the base cap includes a closing cap including internal threads for selectably engaging with the external threads of the first engagement portion of the nozzle portion to provide a seal for the package.

6. The method of claim 5, further comprising:

removing, prior to attaching the base cap to the filling port, the closing cap from the base cap by rotatably disengaging the closing cap from the external threads of the first engagement portion until the closing cap is separated from the nozzle portion.

7. The method of claim 6, wherein the closing cap includes an indicator ring, and wherein when the closing cap is rotatably disengaged from the first engagement portion, the indicator ring of the closing cap provides a visual indication of the disengagement.

8. The method of claim 5, further comprising:

attaching, subsequent to transferring the at least a portion of the contents, the closing cap to the base cap by rotatably engaging the closing cap with the external threads of the first engagement portion until the closing cap is seated on the nozzle portion.

9. The method of claim 1, wherein the base cap includes an indicator ring extending from the cap body portion so that the cap body portion is arranged between the indicator ring and the nozzle portion; and wherein upon detaching the base cap from the fitment opening of the package, the indicator ring provides visual indication of the detachment.

10. The method of claim 1, wherein the package is a flexible pouch; and wherein the transferring of the at least a portion of the contents within the package to the outdrive comprises compressing the flexible pouch to urge the at least a portion of the contents out of the flexible pouch through the fitment opening.

11. The method of claim 1, wherein the fitment opening includes an external thread; and wherein attaching the base cap to a fitment opening of the package by mating the internal threads with the fitment opening comprises rotatably engaging the internal threads of the base cap with the external thread of the fitment opening.

12. A method of transferring fluid within a flexible package to a motor, comprising:

using a base cap including a cap body portion having internal threads, a nozzle portion comprising a first engagement portion extending from the cap body portion and having external threads of a first diameter and of a first thread pattern, and a second engagement portion extending from the first engagement portion and having external threads of a second diameter smaller than the first diameter and of a second thread pattern;

wherein the cap body portion of the base cap is attached to the an opening of the package;

attaching the base cap to a port of the motor by mating the nozzle portion with the port to facilitate transfer of the fluid from the package to the motor; and compressing the flexible pouch to urge at least a portion of the fluid out of the flexible pouch through the base cap and into the port, the port being lower than the base cap.

13. The method of claim 11, wherein attaching the base cap to the port further comprises mating the external threads of one of the first engagement portion and the second engagement portion to the port to facilitate transfer of the fluid from the package to the port.

14. The method of claim 11, wherein the first thread pattern and the second thread pattern are a same thread type or a different thread type.

15. The method of claim 12, wherein the first thread pattern is a Universal Standard Thread (UST) pattern mateable with a complementary UST pattern of a filling port; and the second thread pattern is an International Organization for Standardization (ISO) Metric thread pattern mateable with a complementary ISO pattern of a filling port.

16. The method of claim 1, wherein the base cap includes a closing cap including internal threads for selectably engaging with the external threads of the first engagement portion of the nozzle portion to provide a seal for the package.

17. The method of claim 16, further comprising:

removing, prior to attaching the base cap to the filling port, the closing cap from the base cap by rotatably disengaging the closing cap from the external threads of the first engagement portion until the closing cap is separated from the nozzle portion.

18. The method of claim 16, further comprising:

attaching, subsequent to transferring the at least a portion of the fluid, the closing cap to the base cap by rotatably engaging the closing cap with the external threads of the first engagement portion until the closing cap is seated on the nozzle portion.

19. A method of transferring contents within a package to a target system, comprising:

using a base cap including a cap body portion having internal threads, a nozzle portion comprising a first engagement portion extending from the cap body portion with external threads of a Universal Standard Thread (UST) pattern to selectably engage with a filling port of a second target marine outdrive comprising a UST pattern, a second engagement portion disposed adjacent to the first engagement portion, and comprising external threads of an International Organization for Standardization (ISO) Metric thread pattern and sized to fit and to selectably engage with a filling port of a first target marine outdrive comprising an ISO pattern thread; and a closing cap having internal threads of the UST pattern sized to selectably engage with the first engagement portion of the nozzle portion;

attaching the base cap to an opening of the package by mating the internal threads with the fitment opening to provide a sealable engagement between the base cap and the package, wherein the closing cap is provides a seal for the package when the base cap is engaged with the opening and the closing cap is engaged with the first engagement portion;

attaching the base cap to one of the filling port of the second target marine outdrive and the filling port of the first target marine outdrive by mating the nozzle portion with the port to facilitate transfer of the contents from the package to the one of the second target marine outdrive and the first target marine outdrive, the filling port of the second target marine outdrive and the filling port of the first target marine outdrive being lower than the base cap; and transferring at least a portion of the contents within the package to the one of the second target marine outdrive and the first target marine outdrive.

20. The method of claim 19, wherein the base cap includes an indicator ring extending from the cap body portion so that the cap body portion is arranged between the indicator ring and the nozzle portion; and wherein upon detaching the base cap from the fitment opening of the package, the indicator ring provides visual indication of the detachment.

* * * * *